US011152690B2

(12) United States Patent
Mizuno et al.

(10) Patent No.: US 11,152,690 B2
(45) Date of Patent: Oct. 19, 2021

(54) ANTENNA DEVICE FOR VEHICLE

(71) Applicant: YOKOWO CO., LTD., Tokyo (JP)

(72) Inventors: Hirotoshi Mizuno, Tomioka (JP); Takayuki Sone, Tomioka (JP)

(73) Assignee: YOKOWO CO., LTD., Tokyo (JP)

( * ) Notice: Subject to any disclaimer, the term of this patent is extended or adjusted under 35 U.S.C. 154(b) by 91 days.

(21) Appl. No.: 16/609,749

(22) PCT Filed: Aug. 3, 2018

(86) PCT No.: PCT/JP2018/029193
§ 371 (c)(1),
(2) Date: Oct. 31, 2019

(87) PCT Pub. No.: WO2019/027036
PCT Pub. Date: Feb. 7, 2019

(65) Prior Publication Data

US 2020/0067180 A1 Feb. 27, 2020

(30) Foreign Application Priority Data

Aug. 4, 2017 (JP) ..... JP2017-151914

(51) Int. Cl.
*H01Q 1/32* (2006.01)
*H01Q 9/04* (2006.01)
*H01Q 21/06* (2006.01)

(52) U.S. Cl.
CPC ..... *H01Q 1/32* (2013.01); *H01Q 9/0407* (2013.01); *H01Q 21/065* (2013.01)

(58) Field of Classification Search
CPC ..... H01Q 1/32; H01Q 21/06; H01Q 21/065; H01Q 9/04; H01Q 9/0407; H01Q 19/22;
(Continued)

(56) References Cited

U.S. PATENT DOCUMENTS 4,204,213 A * 5/1980 Wheeler ..... H01Q 1/085 343/706
4,287,518 A * 9/1981 Frosch ..... H01Q 9/065 343/700 MS
(Continued)

FOREIGN PATENT DOCUMENTS

CN 1591977 A 3/2005
CN 201081821 Y 7/2008
(Continued)

OTHER PUBLICATIONS

Office Action dated Dec. 3, 2020 in Chinese Patent Application No. 201880028562.3, 22 pages.
(Continued)

*Primary Examiner* — Tho G Phan
(74) *Attorney, Agent, or Firm* — Xsensus LLP

(57) ABSTRACT

An antenna device for a vehicle includes an antenna board in which a colinear array antenna is constructed by a conductor pattern provided on each of both surfaces of a dielectric substrate. The colinear array antenna includes a first straight portion, a second straight portion, a first connection portion one end of which is connected to the first straight portion, and a second connection portion one end of which is electrically connected to the first connection portion and another end of which is connected to the second straight portion. The first straight portion and the first connection portion are provided on a first surface of the dielectric substrate. The second straight portion and the second connection portion are provided on a second surface of the dielectric substrate opposite to the first surface.

11 Claims, 11 Drawing Sheets

(58) Field of Classification Search
CPC ..... H01Q 19/26; H01Q 19/32; H01Q 11/16; H01Q 1/22; H01Q 1/3275; H01Q 21/10; H01Q 21/20; H01Q 9/30; H01Q 9/42
See application file for complete search history.

(56) References Cited

U.S. PATENT DOCUMENTS

| | | | | |
|---|---|---|---|---|
| 4,616,233 | A * | 10/1986 | Westerman | H01Q 11/105 343/792.5 |
| 4,872,021 | A | 10/1989 | Tabakov et al. | |
| 6,222,489 | B1 * | 4/2001 | Tsuru | H01Q 1/362 343/700 MS |
| 6,222,494 | B1 | 4/2001 | Erkocevic | |
| 9,653,807 | B2 * | 5/2017 | Binzer | H01Q 21/0075 |
| 10,243,268 | B2 * | 3/2019 | Hasch | H01Q 3/26 |
| 2005/0052334 | A1 | 3/2005 | Ogino et al. | |
| 2014/0078005 | A1 * | 3/2014 | Park | H01Q 13/206 343/700 MS |
| 2015/0188226 | A1 | 7/2015 | Ng et al. | |

FOREIGN PATENT DOCUMENTS

| | | | |
|---|---|---|---|
| GB | 2523443 | A | 8/2015 |
| JP | 63-260203 | A | 10/1988 |
| JP | 2000-49514 | A | 2/2000 |
| JP | 2003-249810 | A | 9/2003 |
| JP | 2005-175557 | A | 6/2005 |
| JP | 2005-236656 | A | 9/2005 |
| JP | 2006-295430 | A | 10/2006 |
| JP | 4147177 | B2 | 9/2008 |
| JP | 2015-133692 | A | 7/2015 |

OTHER PUBLICATIONS

International Search Report and Written Opinion dated Oct. 23, 2018 for PCT/JP2018/029193 filed on Aug. 3, 2018, 11 pages including English Translation of the International Search Report.
Notice of Reasons for Refusal for JP Application No. 2017-151914 filed on Aug. 4, 2017, 6 pages (with English Translation).
Extended European search report dated Mar. 30, 2021, in corresponding European patent Application No. 18840894.2, 8 pages.

* cited by examiner

ANTENNA DEVICE FOR VEHICLE

CROSS-REFERENCE TO RELATED APPLICATIONS

The present application is based on PCT tiling PCT/JP2018/029193, filed Aug. 3, 2018, which claims priority to JP 2017-151914, filed Aug. 4, 2017, the entire contents of each are incorporated herein by reference.

TECHNICAL FIELD

The present invention relates to an antenna device for a vehicle that is installed in a vehicle and used for V2X (Vehicle-to-X, Vehicle-to-Everything) communication (e.g., vehicle-to-vehicle communication and road-to-vehicle communication), etc. In particular, the present invention relates to an antenna device for a vehicle that includes an antenna board in which a colinear array antenna is formed.

BACKGROUND ART

An antenna device in which a colinear array antenna is pattern-printed on one surface of a dielectric substrate is known as one of conventional antennas of the above kind. However, since the colinear array antenna has a folded portion for phase matching, a length of a dielectric substrate in a height direction should necessarily be made long in a case where the colinear array antenna is pattern-printed on one surface of the dielectric substrate, thus there is a disadvantage that a height of the antenna device is increased.

CITATION LIST

Patent Literature

Patent document 1: Japanese Patent No. 4147177

SUMMARY OF INVENTION

Technical Problem

The present invention has been made with recognition of the above circumstances, and an object of the invention is therefore to provide an antenna device for a vehicle in which a height thereof can be lowered.

Solution to Problem

One aspect of the present invention is an antenna device for a vehicle. This antenna device for a vehicle includes an antenna board in which a colinear array antenna is constructed by conductor patterns provided on both surfaces of a dielectric substrate.

In the above aspect, it is preferable that the colinear array antenna includes a first straight portion, a second straight portion, a first connection portion one end of which is connected to the first straight portion, and a second connection portion one end of which is electrically connected to the first connection portion and another end of which is connected to the second straight portion, wherein the first straight portion and the first connection portion are provided on a first surface of the dielectric substrate, and the second straight portion and the second connection portion are provided on a second surface of the dielectric substrate opposite to the first surface.

It is preferable that the first connection portion and the second connection portion are located on the dielectric substrate at approximately the same height.

It is preferable that the first straight portion is inclined with respect to an extension direction of the second straight portion.

It is preferable that at least one of a first director that is parallel with the first straight portion and a second director that is parallel with the second straight portion is provided on the dielectric substrate.

It is preferable that a parallel line portion that is parallel with the second straight portion is provided on the second surface of the dielectric substrate.

It is preferable that the dielectric substrate is formed with a cut or a hollow portion between the second straight portion and the parallel line portion.

It is preferable that the colinear array antenna operates at a first frequency and a second frequency that is different from the first frequency.

It is preferable that the antenna device for vehicle further includes a capacitance loading element, wherein the antenna board is spaced from the capacitance loading element in a direction in which the first connection portion and the second connection portion respectively extend from the first straight portion and the second straight portion.

Any combinations of the above constituent elements and what are obtained by converting expressions of the invention between methods, systems, etc. are also effective embodiments of the invention.

Advantageous Effects of Invention

According to the invention, it is possible to lower a height of an antenna device for a vehicle.

DESCRIPTION OF EMBODIMENTS

Figure 1:
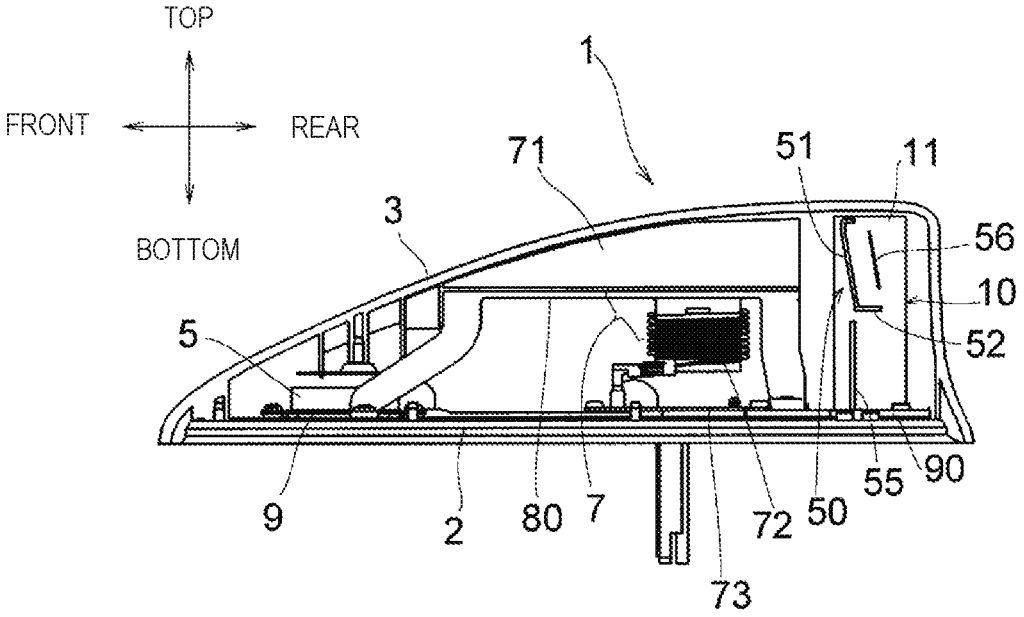
FIG. 1 is a left side view, with its head located on the front side, of an antenna device for a vehicle according to a first embodiment of the present invention.
Figure 2:
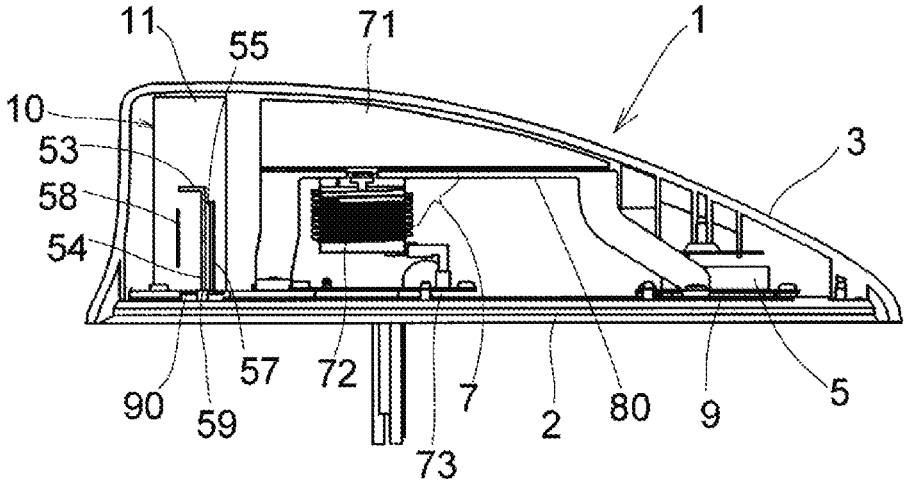
FIG. 2 is a right side view, with its head located on the front side, of the same.

Preferred embodiments of the present invention will be hereinafter described in detail with reference to the drawings. The same or equivalent constituent elements, members, treatment/working processes, or the like shown in the drawings are given the same symbol and redundant descriptions therefor will be avoided as appropriate. The embodiments are just examples and are not intended to restrict the invention; it is not always the case that all of features described in the embodiments or combinations of those features are essential to the invention.

Embodiment 1

An antenna device for a vehicle according to a first embodiment of the invention will be described with reference to FIGS. 1-6. As shown in these drawings, the antenna device for the vehicle 1 is equipped with a metal base 2 and a radio wave transmissive case (a radome) 3 which is screwed to the base 2 so as to cover the base 2 from above. In this antenna device for the vehicle 1, an SXM antenna (patch antenna) 5, an AM/FM broadcast reception antenna 7, and an antenna board 10 in which a V2X communication colinear array antenna is provided are installed in an internal space defined by the base 2 and the case 3 so as to be arranged in this order from the front side. The SXM antenna 5, which is equipped with a radiation electrode provided on a top surface the top and has upward directivity, is fixed to the base 2 via a board 9. The top-bottom direction and the front-rear direction of the antenna device for the vehicle 1 are defined in FIG. 1. The top side and the bottom side are the destination sides of the upward direction and the downward direction on the paper surface, respectively, and the left side and the right side are the destination sides of the leftward direction and the rightward direction on the paper surface, respectively.

Figure 3:
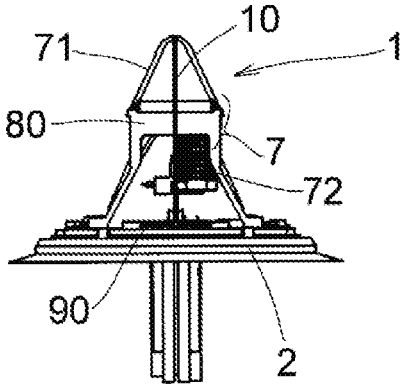
FIG. 3 is a rear view of the same with a case omitted.
Figure 4:
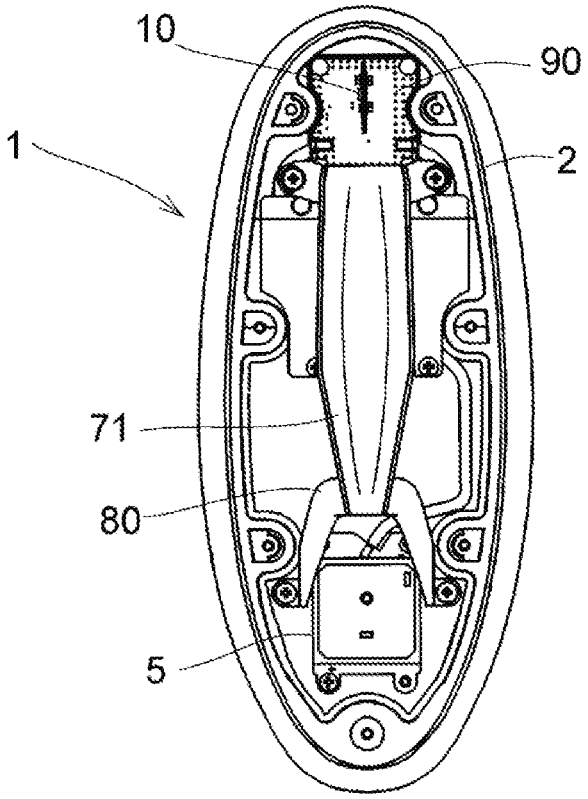
FIG. 4 is a plan view of the same with the case omitted.

The AM/FM broadcast reception antenna 7 has a capacitance loading element 71 and a coil 72 which is series-connected to the capacitance loading element 71. The capacitance loading element 71 is fixed to a holder 80 which is erected from and fixed to the base 2. As shown in FIG. 3, the capacitance loading element 71 has a structure which is not divided, is an umbrella-shaped conductor that extends parallel with the external surface of the holder 80, and is fixed to the holder 80. The coil 72 is attached to the holder 80 and the bottom end of the coil 72 is connected to an amplifier board 73 which is fixed to the base 2.

Figure 5:
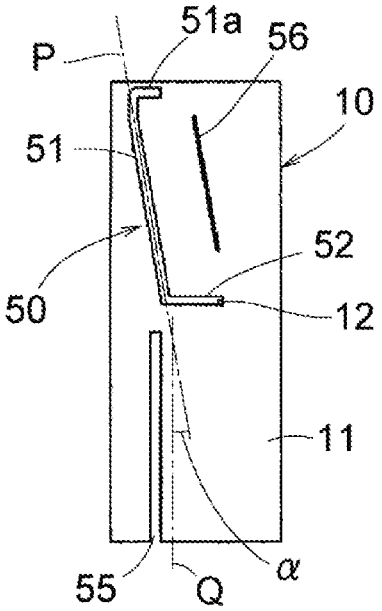
FIG. 5 is a left side view, with its head located on the front side, of an antenna board 10 employed in the first embodiment in which a colinear array antenna is formed.
Figure 6:
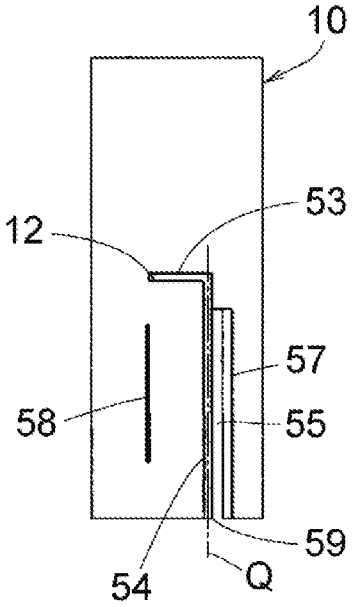
FIG. 6 is a right side view, with its head located on the front side, of the same antenna board 10.

The antenna board 10 having a colinear array antenna 50 is erected perpendicularly from and fixed to a feeding attachment board (an attachment member) 90 which is fixed to the base 2. As shown in FIGS. 5 and 6, in the antenna board 10, the colinear array antenna 50 etc. are constructed by conductor patterns provided on the two surfaces of a dielectric substrate 11 by printing, etching of a conductor foil, or the like. The colinear array antenna 50 has, as conductor patterns, straight portions 51 and 54 and connection portions 52 and 53 for phase matching. The straight portion 51 which extends in a direction that is inclined with respect to the top-bottom direction of the dielectric substrate 11 and the connection portion 52 which extends in the width direction of the dielectric substrate 11 (i.e., a front-rear direction of the antenna device for the vehicle 1) are provided on the left side surface of the dielectric substrate 11 (see FIG. 5). The connection portion 53 which extends in the width direction of the dielectric substrate 11 (i.e., the front-rear direction of the antenna device for the vehicle 1) and the straight portion 54 which extends in the top-bottom direction of the dielectric substrate 11 are provided on the right side surface of the dielectric substrate 11 (see FIG. 6). The connection portions 52 and 53 are electrically connected to each other, for example, through a through-hole 12 which is formed at their rear ends. A top portion of the upper straight portion 51 is a portion 51*a* which is bent so as to extend alongside the top side of the dielectric substrate 11. This is because the length of the dielectric substrate 11 in the top-bottom direction is insufficient. The formation of the bent portion 51*a* makes it possible to obtain a length that is required for the straight portion 51 even in the case where the dielectric substrate 11 is small in height. The bent portion 51*a* has no large influence on the characteristics of the colinear array antenna unless the bent portion 51*a* is too long. Colinear array antennas are antennas that perform an array antenna operation and have a directivity which is obtained by synthesizing a directivity of an upper element (the straight portion 51) and a directivity of a lower element (the straight portion 54). In contrast, dipole antennas are antennas that do not perform an array antenna operation and in which a feeding point is not located on a ground plate and elements are located above and below the feeding point. Monopole antennas are antennas in which a feeding point is located on a ground plate and the ground plate and an element perform an antenna operation. As such, colinear array antennas are antennas that perform a different kind of operation than dipole antennas and monopole antennas.

In the colinear array antenna 50, the folded portions for phase matching (the connection portions 52 and 53) are provided at the same height by utilizing the front surface and the back surface (left side surface and right side surface) of the dielectric substrate 11. Thus, the height of the dielectric substrate 11, that is, the antenna board 10, can be made small, whereby the height of the antenna device for the vehicle 1 can be lowered.

Incidentally, if an antenna board is installed on a roof, inclined with respect to a horizontal plane, of a vehicle in the vicinity of the rear windshield, a phenomenon occurs that part of electromagnetic waves propagate through the windshield and, as a result, the gain is lowered around the elevation angle 0°. To prevent this phenomenon, in the antenna board 10 employed in the embodiment, the straight portion 51 is a little inclined forward. That is, as shown in FIG. 5, in the colinear array antenna 50, the extension direction (indicated by a straight line P) of the upper straight portion 51 is inclined with respect to the extension direction (indicated by a straight line Q that is parallel with the top-bottom direction of the dielectric substrate 11) of the lower straight portion 54. That is, where the antenna board 10 is attached perpendicularly to the feeding attachment board (attachment member) 90 which is fixed to the base 2 (see FIG. 3), the lower straight portion 54 extends in the top-bottom direction of the dielectric substrate 11 as shown in the right side view (FIG. 6) of the dielectric substrate 11 whereas the upper straight portion 51 is inclined forward with respect to the top-bottom direction of the dielectric substrate 11, as a result of which the top end of the straight portion 51 is located in front of the bottom end of the straight portion 51. The angle $\alpha$ formed by the straight lines P and Q is a small angle that is smaller than 45°. Detailed workings and advantages of the arrangement that the extension direction of the upper straight portion 51 is inclined forward with respect to that of the lower straight portion 54 will be described later.

Furthermore, to increase gains on the rear side in horizontal directions, in the antenna board 10, directors 56 and 58 are provided on the dielectric substrate 11 in the form of conductor patterns so as to be associated with the respective straight portions 51 and 54 of the colinear array antenna 50. As shown in FIG. 5, the director 56 is provided in the rear of the straight portion 51 on the left side surface of the dielectric substrate 11 so as to be parallel with the straight portion 51. As shown in FIG. 6, the director 58 is provided in the rear of the straight portion 54 on the right side surface of the dielectric substrate 11 so as to be parallel with the straight portion 54. The directors 56 and 58 are shorter than the respective straight portions 51 and 54. The director 56 is shorter than the straight portion 51 excluding the bent portion 51*a*.

As shown in FIG. 6, a parallel line portion 57 is provided parallel with the straight portion 54 on the right side surface of the dielectric substrate 11 in the form of a conductor pattern and forms a parallel-line transmission line with the straight portion 54. A slit-shaped cut (the hollow portion) 55 is formed in the dielectric substrate 11 between the straight portion 54 and the parallel line portion 57 which form the parallel-line transmission line. The bottom end of the parallel line portion 57 is connected to a ground (GND) conductor of the feeding attachment board 90. Since a feeding portion 59 (the bottom end of the straight portion 54) is located at a low position, the colinear array antenna 50 has a current distribution that the current is small in an upper region (on the side of the straight portion 51) and large in a lower region (on the side of the straight portion 54). The parallel line portion 57 has a role of "pushing up" current that is large in the lower region. The slit-shaped cut (the hollow portion) 55 serves to decrease the permittivity between the straight portion 54 and the parallel line portion 57 and thereby match the phase of electromagnetic waves traveling between the straight portion 54 and the ground (GND) conductor with that of electromagnetic waves traveling through the parallel-line transmission line (the straight portion 54 and the parallel line portion 57).

The feeding portion 59 of the colinear array antenna 50 provided in the antenna board 10 is the bottom end of the straight portion 54 (i.e., a connection point to the feeding attachment board 90) and is located at a position that is lower than the radiation electrode surface of the SXM antenna 5. Where the colinear array antenna 50 is for V2X communication, the colinear array antenna 50 transmits and receives radio waves in the 5.9-GHz band by the antenna board 10.

Figure 7A:
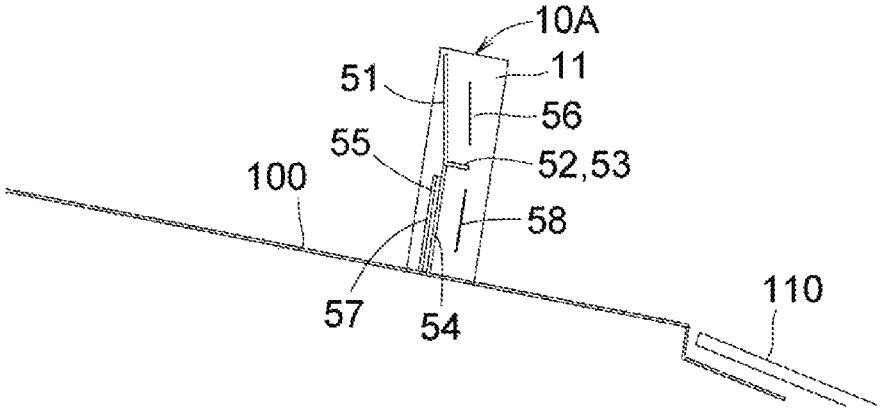
FIG. 7A is a schematic diagram showing a measurement model in a case that an antenna board 10A which is similar to the antenna board 10 employed in the first embodiment is installed on a slant roof that is located in the vicinity of a glass plate of a vehicle and is inclined with respect to a horizontal plane.

FIG. 7A is a schematic diagram showing a measurement model in a case that a glass plate 110 exists adjacent to a slant roof 100 of a vehicle and an antenna board 10A which is similar to the antenna board 10 employed in the first embodiment is installed on the roof 100. The conductor patterns provided on the left side surface and those formed on the right side surface are shown in superimposition. It is assumed that the antenna board 10A is located in the vicinity of the glass plate 110 and erected from the roof 100 of the vehicle and the whole of the upper straight portion 51 provided on the dielectric substrate 11 extends straightly (i.e., having no bent portion). In this case, the lower straight portion 54 is perpendicular to the roof whereas the upper straight portion 51 is not perpendicular (it is inclined with respect to the front edge of the dielectric substrate 11). This is to alleviate the above-described phenomenon that part of electromagnetic waves propagate through the glass plate 110 and the gain is lowered around the elevation angle 0° if the antenna board is installed on the roof, inclined with respect to the horizontal plane, of the vehicle in the vicinity of the rear windshield. Resulting advantages will be described later with reference to FIG. 8A. The other part of the configuration is the same as in the antenna board 10 employed in the first embodiment.

Figure 7B:
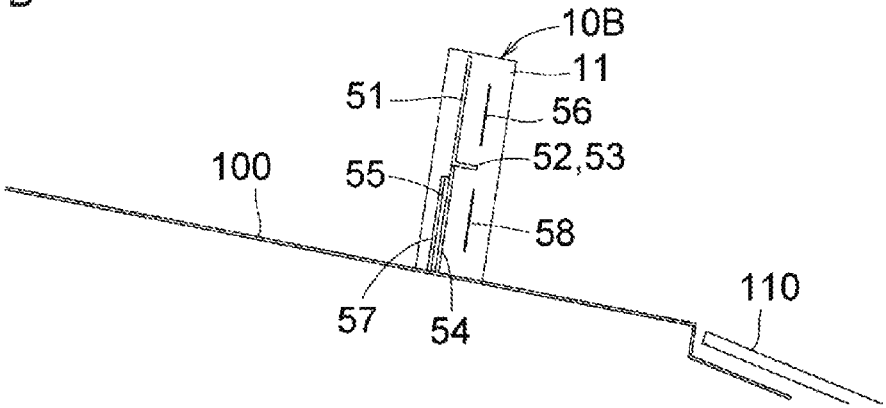
FIG. 7B is a schematic diagram showing a measurement model in a case that an antenna board 10B of Comparative Example 1 is installed on a similar slant roof.

FIG. 7B is a schematic diagram showing a measurement model in a case that a glass plate 110 exists adjacent to a slant roof 100 of a vehicle and an antenna board 10B of Comparative Example 1 is installed on the roof 100. Conductor patterns provided on the left side surface and conductor patterns provided on the right side surface are shown in superimposition. It is assumed that the antenna board 10B is located in the vicinity of the glass plate 110 and erected from the roof 10) of the vehicle. In this case, an upper straight portion 51 and a lower straight portion 54 are arranged on a single straight line that is parallel with the front edge of a dielectric substrate 11 and are perpendicular to the roof 100. The other part of the configuration is the same as in the antenna board 10 employed in the first embodiment.

Figure 7C:
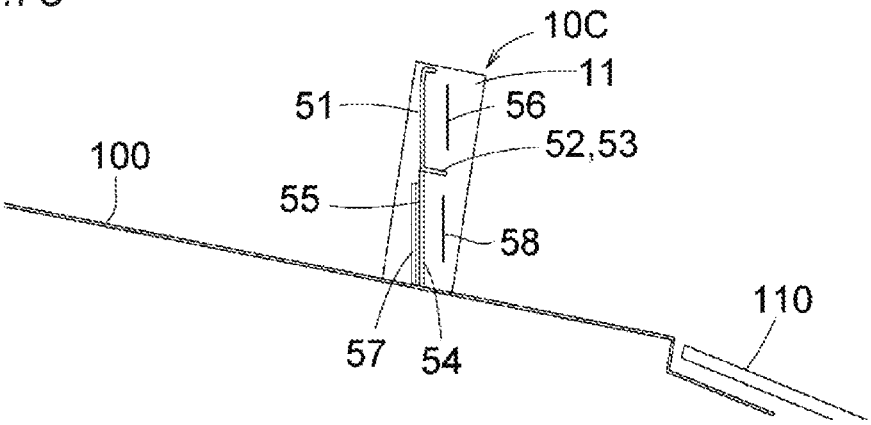
FIG. 7C is a schematic diagram showing a measurement model in a case that an antenna board 10C of Comparative Example 2 is installed on a similar slant roof

FIG. 7C is a schematic diagram showing a measurement model in a case that a glass plate 110 exists adjacent to a slant roof 100 of a vehicle and an antenna board 10C of Comparative Example 2 is installed on the roof 100. Conductor patterns provided on the left side surface and conductor patterns provided on the right side surface are shown in superimposition. It is assumed that the antenna board 10C is located in the vicinity of the glass plate 110 and erected from the roof 100 of the vehicle. In this case, an upper straight portion 51 is inclined forward with respect to the front edge of a dielectric substrate 11 as in the measurement model shown in FIG. 7A and, likewise, a lower straight portion 54 is inclined forward with respect to the front edge of the dielectric substrate 11. Thus, the straight portions 51 and 54 are arranged on a single straight line. The other part of the configuration is the same as in the antenna board 10 employed in the first embodiment.

Figure 8A:
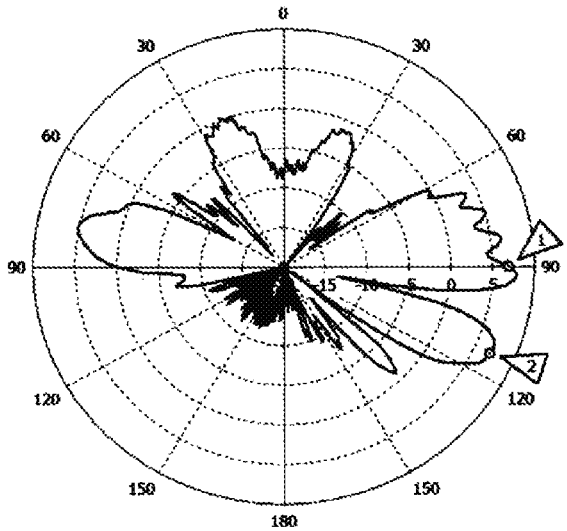
FIG. 8A is a directivity characteristic diagram, produced by a simulation, showing vertical plane gains in the case of the measurement model shown in FIG. 7A.

FIG. 8A is a directivity characteristic diagram, produced by a simulation, showing vertical plane gains at a frequency 5,887.5 MHz in the case of the measurement model shown in FIG. 7A which uses the antenna board 10A which is similar to the antenna board 10 employed in the first embodiment. An angle 90° on the right side in FIG. 8A corresponds to a horizontal direction (the elevation angle: 0°) of the side (the rear side) on which the directors 56 and 58 are located so as to be opposed to the straight portions 51 and 54 on the dielectric substrate 11, and an angle of about 114° on the right side in FIG. 8A corresponds to a direction that is approximately parallel with the glass plate 110. A gain at the position indicated by a marker 1 (90° on the right side) is 6.886 dBi and a gain at the position indicated by a marker 2 (114° on the right side) is 6.868 dBi. The gain on the rear side in the horizontal direction is larger than the gain in the direction that is approximately parallel with the glass plate 110.

Figure 8B:
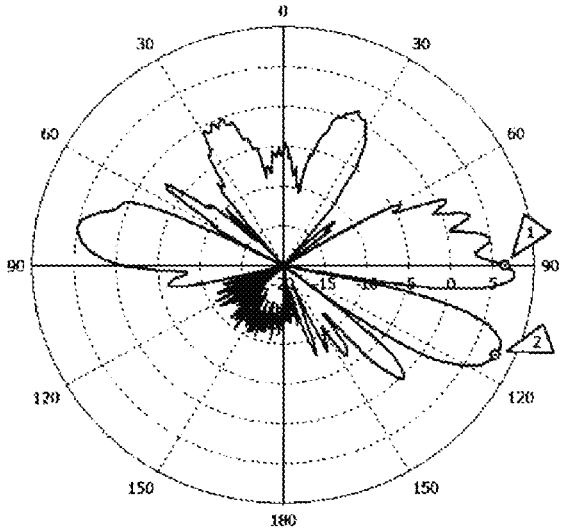
FIG. 8B is a directivity characteristic diagram, produced by a simulation, showing vertical plane gains in the case of the measurement model shown in FIG. 7B.

FIG. 8B is a directivity characteristic diagram, produced by a simulation, showing vertical plane gains at a frequency 5,887.5 MHz in the case of the measurement model shown in FIG. 7B which uses the antenna board 10B of Comparative Example 1. A gain at the position indicated by a marker 1 (90° on the right side) is 6.419 dBi and a gain at the position indicated by a marker 2 (114° on the right side) is 7.711 dBi. The gain in the direction that is approximately parallel with the glass plate 110 is larger than the gain in the direction on the rear side in the horizontal direction as a result of influence of the glass plate 110.

Figure 8C:
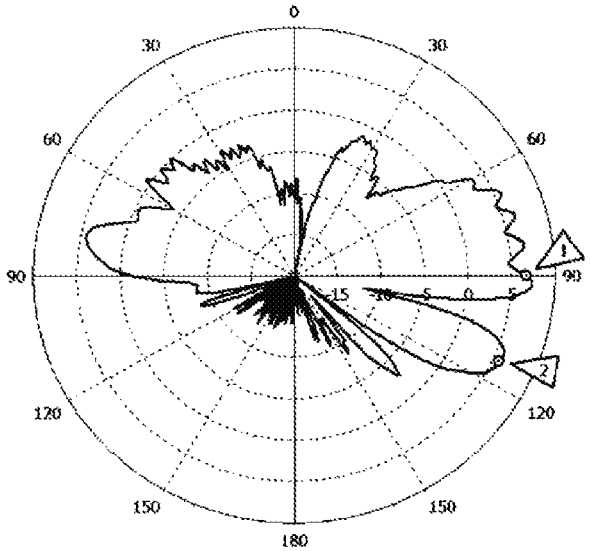
FIG. 8C is a directivity characteristic diagram, produced by a simulation, showing vertical plane gains in the case of the measurement model shown in FIG. 7C.

FIG. 8C is a directivity characteristic diagram, produced by a simulation, showing vertical plane gains at a frequency 5,887.5 MHz in the case of the measurement model shown in FIG. 7C which uses the antenna board 10C of Comparative Example 2. A gain at the position indicated by a marker 1 (90° on the right side) is 6.572 dBi and a gain at the position indicated by a marker 2 (114° on the right side) is 5.70 dBi. The gain on the rear side in the horizontal direction is larger than the gain in the direction that is approximately parallel with the glass plate 110. However, the gain indicated by marker 1 is lower than in FIG. 8A.

It is seen from the comparisons between FIGS. 8A, 8B, and 8C that the measurement model using the antenna board 10A which is similar to the antenna board 10 employed in the first embodiment provides the largest gain on the rear side in the horizontal direction (elevation angle: 0°) and hence the antenna board 10A is most preferable.

Figure 9:
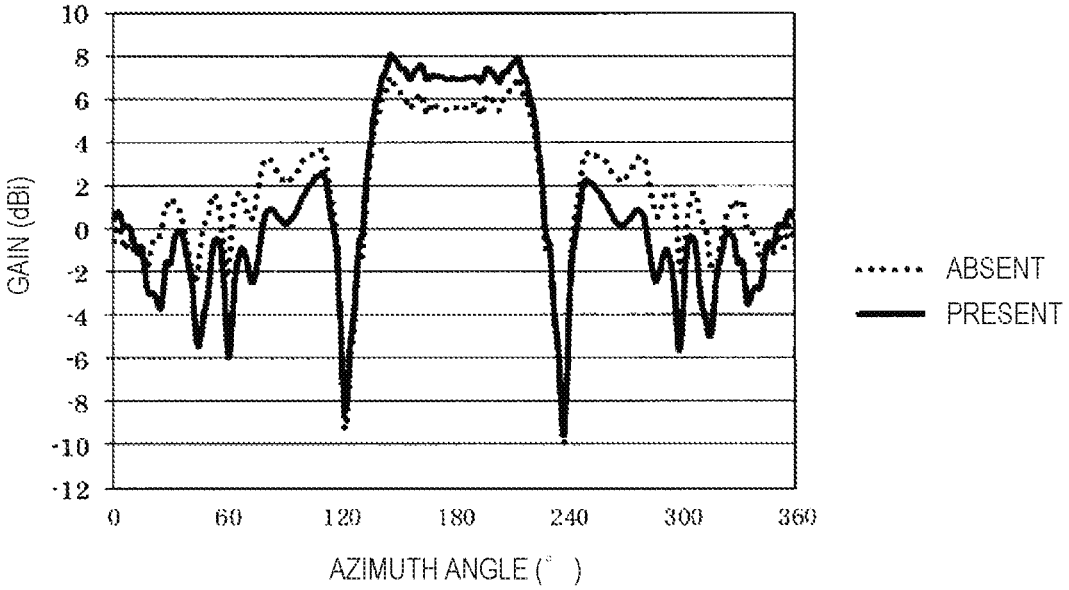
FIG. 9 is a directivity characteristic diagram, produced by simulations, showing horizontal plane directivity characteristics (elevation angle: 0°) of the antenna board 10 employed in the first embodiment in which directors are provided and an antenna board for comparison without the directors.

FIG. 9 is a directivity characteristic diagram, produced by simulations, showing horizontal plane directivity characteristics (the elevation angle: 0°) at 5,887.5 MHz of the antenna board 10 employed in the first embodiment in which the directors 56 and 58 are formed and an antenna board for comparison without the directors 56 and 58. In this diagram, an azimuth angle 180° corresponds to the horizontal direction of the just rear side. A horizontal plane average gain (the elevation angle: 0°) of the antenna board 10 with the directors (a solid line) is 2.83 dBi and a horizontal plane average gain (the elevation angle: 0°) of the antenna board without the directors (a dotted line) is 2.77 dBi. It is seen that the antenna board 10 with the directors (the solid line) has larger gains in an azimuth angle range of 120° to 240° than the antenna board without the directors (the dotted line).

Figure 10:
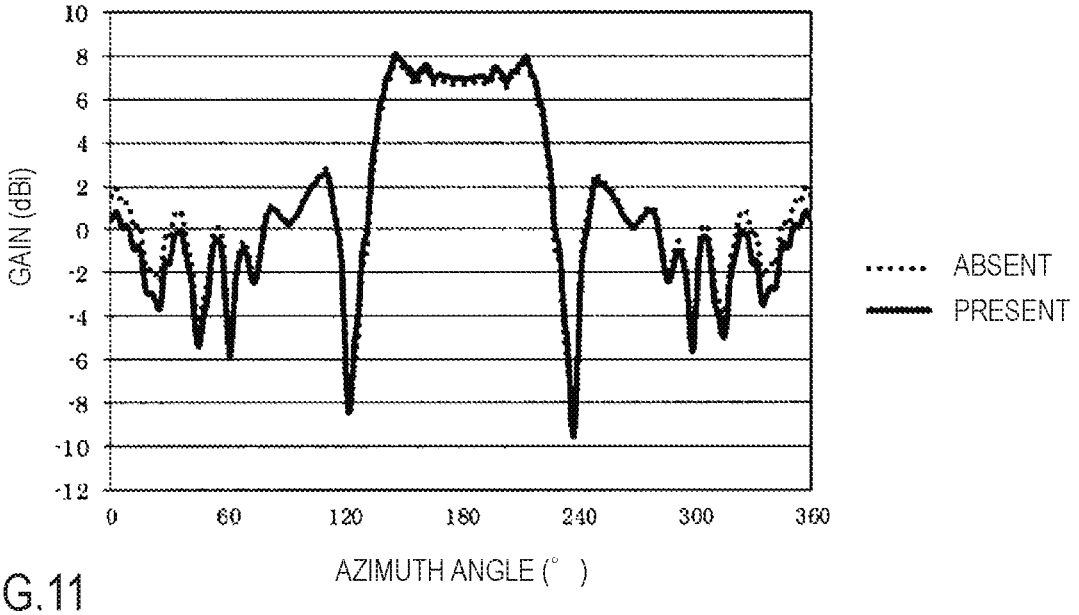
FIG. 10 is a directivity characteristic diagram, produced by simulations, showing horizontal plane directivity characteristics (elevation angle: 0°) of the antenna board 10 employed in the first embodiment in which a parallel line portion is provided and an antenna board for comparison without the parallel line portion.

FIG. 10 is a directivity characteristic diagram, produced by simulations, showing horizontal plane directivity characteristics at 5,887.5 MHz of the antenna board 10 employed in the first embodiment in which the parallel line portion 57 is provided (the slit-shaped cut (the hollow portion) 55 is also formed) and an antenna board for comparison without the parallel line portion 57. In this diagram, an azimuth angle 180° corresponds to the horizontal direction of the just rear side. A horizontal plane average gain (the elevation angle: 0°) of the antenna board 10 with the parallel line portion (a solid line) in the rear half (the azimuth angle: 90° to 270°) is 4.86 dBi and a horizontal plane average gain (the elevation angle: 0°) of the antenna board without the parallel line portion (a dotted line) is 4.66 dBi. Since the feeding portion 59 is located at a low position, that is, at the bottom of the straight portion 54, the colinear array antenna 50 has a current distribution that the current is small in an upper region and large in a lower region. The parallel line portion 57 has a role of "pushing up" current that is large in the lower region. Thus, by forming the parallel line portion 57, the horizontal plane average gain (the elevation angle: 0°) of the colinear array antenna 50 is made larger than in the case that parallel line portion 57 is not provided.

Figure 11:
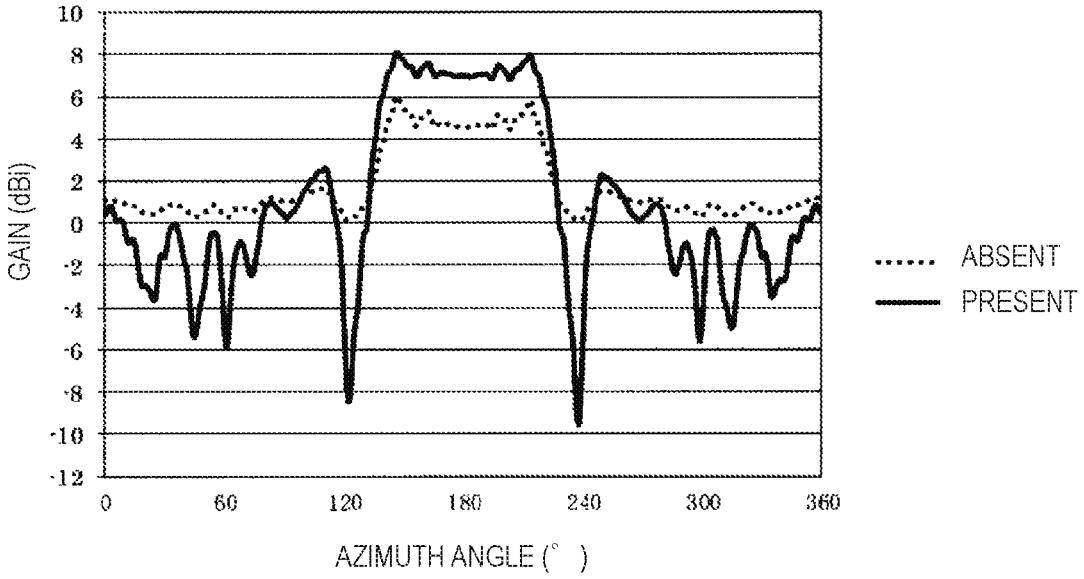
FIG. 11 is a directivity characteristic diagram, produced by simulations, showing horizontal plane directivity characteristics (elevation angle: 0°) of the antenna board 10 employed in the first embodiment in which a slit-shaped cut (hollow portion) is formed and an antenna board for comparison without the slit-shaped cut.

FIG. 11 is a directivity characteristic diagram, produced by simulations, showing horizontal plane directivity characteristics at 5,887.5 MHz of the antenna board 10 employed in the first embodiment in which the slit-shaped cut (the hollow portion) 55 is formed and an antenna board for comparison without the slit-shaped cut (the hollow portion) 55. In this diagram, an azimuth angle 180° corresponds to the horizontal direction of the just rear side. It is seen that the antenna board 10 with the slit-shaped cut (a solid line) has larger gains in an azimuth angle range of 120° to 240° than the antenna board without the slit-shaped cut (a dotted line). A horizontal plane average gain (the elevation angle: 0°) of the antenna board 10 with the slit-shaped cut 55 is 2.83 dBi and a horizontal plane average gain (the elevation angle: 0°) of the antenna board without the slit-shaped cut 55 is 2.20 dBi. Where the slit-shaped cut 55 is not formed, there may occur a phenomenon that a phase deviation occurs between electromagnetic waves that propagate between the straight portion 54 and the ground (GND) conductor and electromagnetic waves that propagate through the parallel-line transmission line (the straight portion 54 and the parallel line portion 57), resulting in gain reduction of the straight portion 51. Since this problem can be solved by forming the slit-shaped cut 55, the horizontal plane average gain (the elevation angle: 0°) of the colinear array antenna 50 is made larger than in the case without the slit-shaped cut 55.

Figure 12:
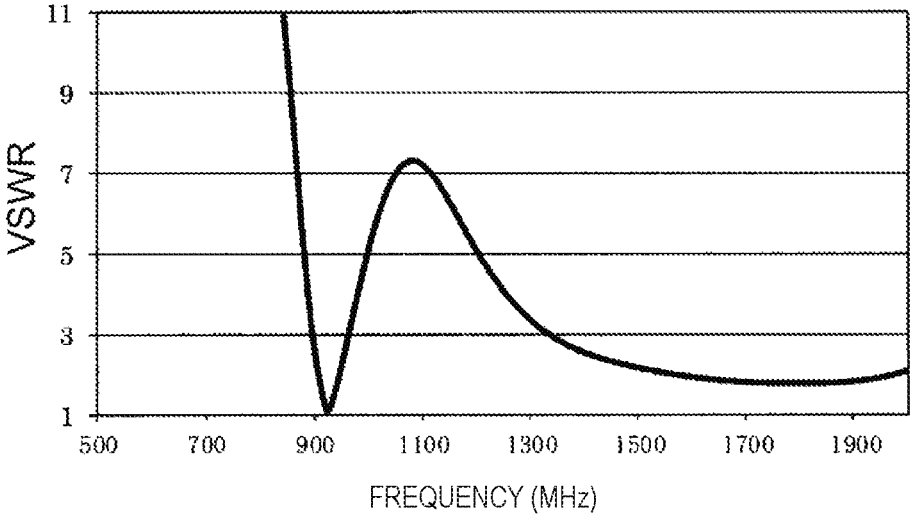
FIG. 12 is a VSWR characteristic diagram of the antenna board 10 employed in the first embodiment.

FIG. 12 is a VSWR characteristic diagram of the antenna board 10 employed in the first embodiment. In addition to being used at frequencies in the 5.9-GHz band which is used for V2X communication, the colinear array antenna 50 operates as a vertically polarized wave antenna even at frequencies of the 925-MHz band (VSWR is close to 1 in the 925-MHz band) which is used in remote control systems (e.g., keyless entry systems, remote start systems, and bi-directional remote engine starters). It is therefore unnecessary to provide elements for a remote control system other than the colinear array antenna 50 and hence the antenna device for the vehicle 1 can be minimized.

Figure 13:
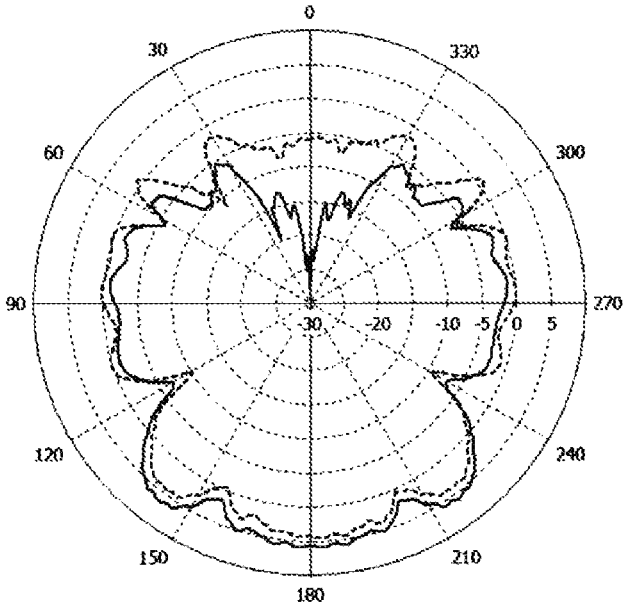
FIG. 13 is a directivity characteristic diagram, produced by simulations, comparing horizontal plane directivity characteristics of the antenna device for a vehicle 1 according to the first embodiment which includes a capacitance loading element and an antenna device for a vehicle without the capacitance loading element.
Figure 14:
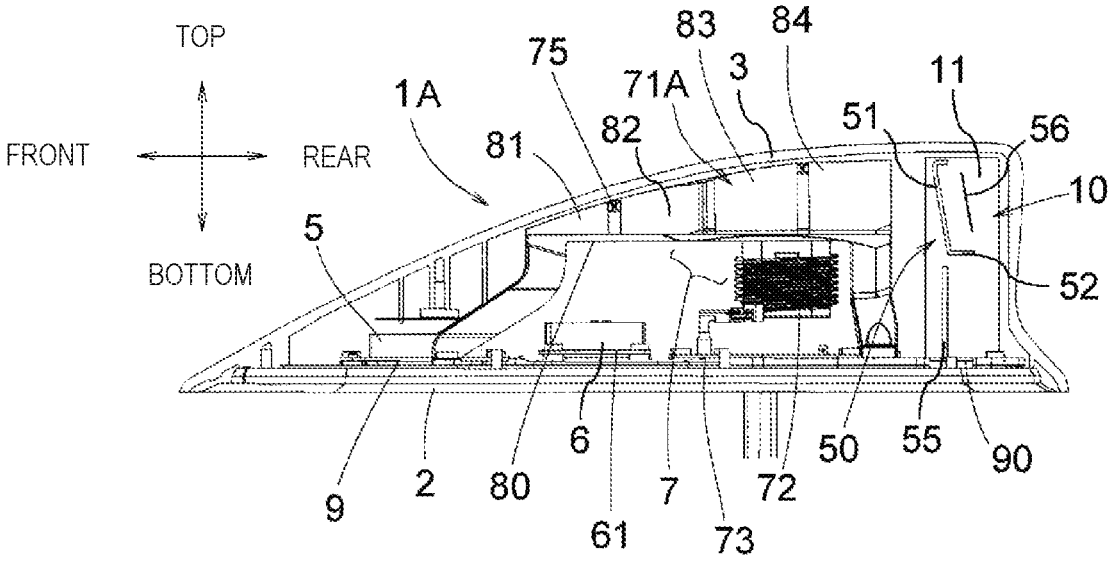
FIG. 14 is a left side view, with its head located on the front side, of an antenna device for a vehicle according to a second embodiment of the invention.
Figure 15:
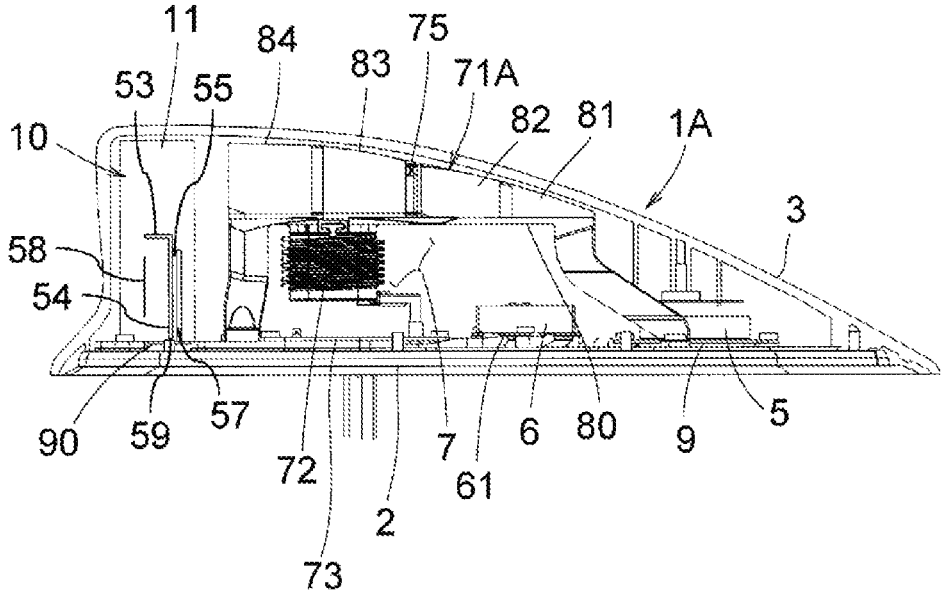
FIG. 15 is a right side view of the same.

FIG. 13 is a directivity characteristic diagram, produced by simulations, horizontal plane directivity characteristics (the elevation angle: 0°) at 5,887.5 MHz of antenna device for the vehicle 1 according to the first embodiment which is equipped with the capacitance loading element 71 and an antenna device for vehicle for comparison without the capacitance loading element 71. In this diagram, an azimuth angle 180° corresponds to the horizontal direction of the just rear side. The distance in the front-rear direction between the capacitance loading element 71 and the colinear array antenna 50 of the antenna board 10 is equal to ¼ at frequencies in the 5.9-GHz band. A horizontal plane average gain (the elevation angle: 0°) of the antenna device for the vehicle 1 with the capacitance loading element (a solid line) in the rear half (azimuth angle: 90° to 270°) is 2.64 dBi and a horizontal plane average gain (the elevation angle: 0°) of the antenna device for the vehicle without the capacitance loading element (a dotted line) in the rear half is 1.38 dBi. Since the capacitance loading element 71 functions as a reflector, gains in the azimuth angle range of 120° to 240° are larger in the case with the capacitance loading element (the solid line) than in the case without the capacitance loading element (the dotted line).

This embodiment provides the following advantages:

(1) In the antenna board 10, the colinear array antenna 50 is constructed by utilizing the both surfaces of the dielectric substrate 11. With this configuration, the connection portions 52 and 53 which are folded portions for phase matching can be provided at the same height by providing the connection portion 52 on one surface of the dielectric substrate 11 and providing the connection portion 53 on the other surface. Where a colinear array antenna 50 is formed on one surface of a substrate, a gap needs to be formed between the connection portions 52 and 53. Thus, by constructing the colinear array antenna 50 with utilizing the both surfaces of the dielectric substrate 11 and setting the connection portions 52 and 53 at the same height, the height of the antenna board 10 can be lowered and, as a result, the height of the antenna device for the vehicle 1 can be lowered.

(2) Where as shown in FIG. 7A an antenna device for a vehicle is installed on the roof 100 which goes down as the position goes toward the glass plate 110 of the vehicle, part of electromagnetic waves travel through the glass plate to cause a phenomenon that the gain is lowered around the elevation angle 0°. By providing the straight portion 51 as the top portion of the colinear array antenna 50 of the antenna board 10 so that it is a little inclined forward as in the embodiment, the phenomenon that the vertical plane gain of the antenna board 10 is lowered around the elevation angle 0° can be alleviated even in the case where the antenna device for the vehicle 1 is installed on the roof 100 which goes down as the position goes toward the glass plate 110.

(3) Since the directors 56 and 58 are provided so as to be associated with the respective straight portions 51 and 54 of the colinear array antenna 50, horizontal plane gains are made larger on the rear side where the directors 56 and 58 are provided. The horizontal plane average gain is also increased by providing the directors 56 and 58.

(4) In the colinear array antenna 50, the current distribution is such that the current is small in a region around the upper straight portion 51 which is distant from the feeding portion 59 and large in a region around the lower straight portion 54. However, the parallel line portion 57 is provided parallel with the straight portion 54. Thus, the current distribution can be changed so that the current in the region around the upper straight portion 51 is increased. As a result, the horizontal plane average gain (the elevation angle: 0°) of the colinear array antenna 50 can be made larger than in the case that the parallel line portion 57 is not provided.

(5) Where the parallel line portion 57 is formed on the dielectric substrate 11, the presence of the parallel line portion 57 may be a factor in lowering the gain of the straight portion 51 if the slit-shaped cut (the hollow portion) 55 is not formed. However, since the slit-shaped cut 55 is formed in the dielectric substrate 11, adverse effects of the parallel line portion 57 on the gain of the straight portion 51 can be eliminated substantially. As a result, the horizontal plane average gain (the elevation angle: 0°) of the colinear array antenna 50 can be made larger than in the case that the slit-shaped cut 55 is not formed.

(6) The colinear array antenna 50 operates as a vertically polarized wave antenna at frequencies in the 925 MHz band which is used in remote control systems in addition to frequencies in the 5.9 GHz band which is used for V2X communication. The antenna device for the vehicle 1 can be miniaturized because it is not necessary to provide elements for a remote control system other than the colinear array antenna 50.

Embodiment 2

An antenna device for a vehicle according to a second embodiment of the invention will be described with reference to FIGS. 14-17. As shown in these drawings, the antenna device for the vehicle 1A is equipped with a metal base 2 and a radio wave transmissive case (a radome) 3 which is screwed to the base 2 so as to cover the base 2 from above. An SXM antenna (a patch antenna) 5, a GNSS antenna (a patch antenna) 6, an AM/FM broadcast reception antenna 7, and an antenna board 10 in which a V2X communication colinear array antenna is provided are installed in an internal space defined by the base 2 and the case 3 so as to be arranged in this order from the front side. Each of the SXM antenna 5 and the GNSS antenna 6 is equipped with a radiation electrode on a top surface and has upward directivity, and is fixed to the base 2 via a board 9 or 61. The top-bottom direction and the front-rear direction of the antenna device for the vehicle 1A are defined in FIG. 14. The top side and the bottom side are the destination sides of the upward direction and the downward direction on the paper surface, respectively, and the left side and the right side are the destination sides of the leftward direction and the rightward direction on the paper surface, respectively.

Figure 16:
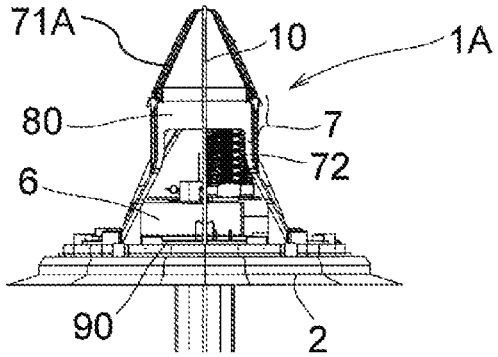
FIG. 16 is a rear view of the same with a case omitted.
Figure 17:
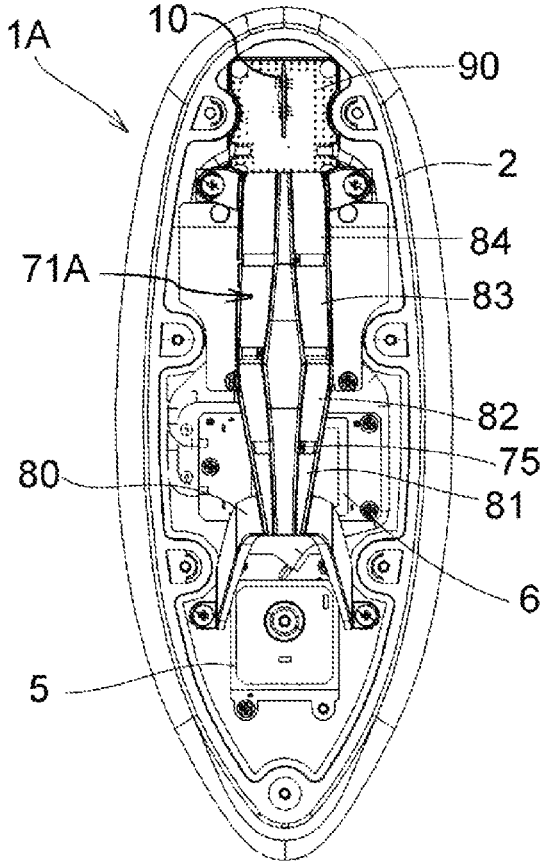
FIG. 17 is a plan view of the same with the case omitted.

The second embodiment is different from the above-described first embodiment in that a capacitance loading element 71A of the AM/FM broadcast reception antenna 7 has a structure which is divided and that the GNSS antenna 6 is disposed under the capacitance loading element 71A. That is, as shown in FIG. 16, the capacitance loading element 71A has no top portion and is configured in such a manner that confronting bottom edges of divided bodies opposed to each other in the left-right direction are connected to each other and its portions separated from each other in the front-rear direction are fixed to a holder 80 individually. The capacitance loading element 71A is configured in such that adjacent ones of divided bodies 81, 82, 83, and 84 each of which is so shaped as to be obtained by connecting mountain-slope-like conductor plates to each other at the bottom are connected to each other by a filter 75. The filter 75 exhibits a low impedance in an AM/FM broadcast frequency band and a high impedance in respective operation frequency bands of the SXM antenna 5 and the GNSS antenna 6. That is, in the AM/FM broadcast frequency band, the divided bodies 81, 82, 83, and 84 can be regarded as being connected to each other to form a single large conductor. A coil 72 is attached to the holder 80, the top end of the coil 72 is connected to the capacitance loading element 71A, and the bottom end of the coil 72 is connected to an amplifier board 73 which is fixed to the base 2. A feeding portion 59 of the colinear array antenna 50 which is provided in the antenna board 10 is the bottom end of a straight portion 54 (i.e., a connection point to a feeding attachment board 90) and is located at a position that is lower than the radiation electrode surfaces of the SXM antenna 5 and the GNSS antenna 6. The other part of the configuration of the second embodiment are the same as that of the above-described first embodiment.

Figure 18:
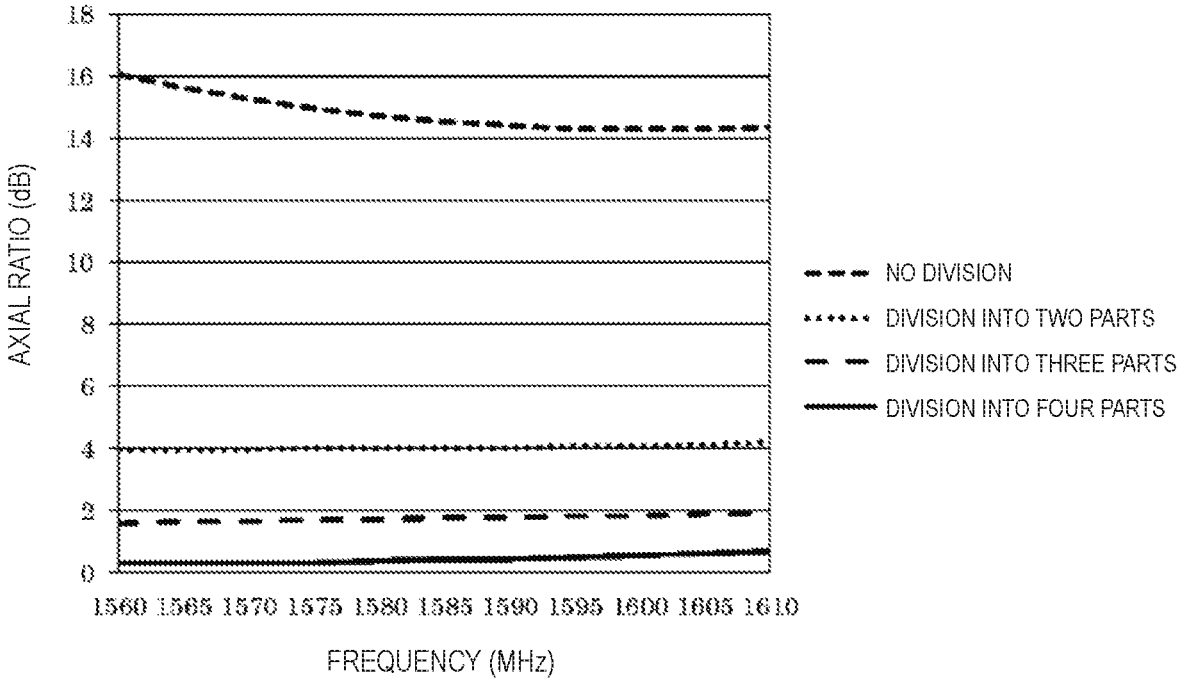
FIG. 18 is a frequency characteristic diagram showing how the axial ratio of a GNSS antenna varies when the division number of a capacitance loading element is changed.
Figure 19:
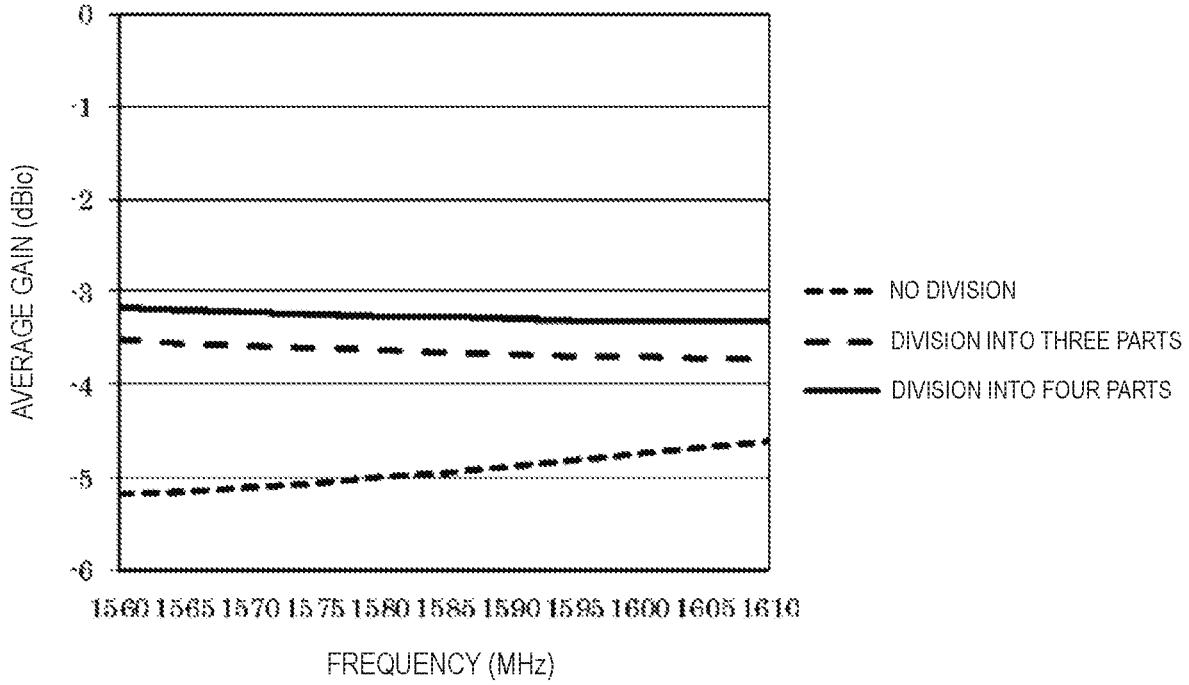
FIG. 19 is a frequency characteristic diagram showing how the average gain of the GNSS antenna varies when the division number of the capacitance loading element is changed.

Although in the configuration of the second embodiment the GNSS antenna 6 is disposed under the capacitance loading element 71, influence of the capacitance loading element 71A is alleviated because the capacitance loading element 71A is divided. FIG. 18 shows a relationship between the division number of the capacitance loading element and the axial ratio of the GNSS antenna 6. Although the axial ratio is not good when it is not divided in the capacitance loading element 71 employed in the first embodiment, the axial ratio becomes smaller and better as the division number is increased in order of two, three, and four (corresponding to the capacitance loading element 71A of the second embodiment). FIG. 19 shows a relationship between the division number of the capacitance loading element and the average gain of the GNSS antenna 6. The average gain of the capacitance loading element 71 of the first embodiment which corresponds to the case where the capacitance loading element 71 is not divided is small. The average gain increases as the division number is increased in order of three and four (corresponding to the capacitance loading element 71A of the second embodiment).

Although the invention has been described above using the embodiments as examples, it would be understood by those skilled in the art that the individual constituent elements and treatment/working processes of the embodiments can be modified in various manners within the confines of the claims. Modifications will be described below.

Although in the first and second embodiments the connection portions 52 and 53 which are folded portions for phase matching are provided at the same height by utilizing the front and back surfaces of the dielectric substrate 11, the connection portions 52 and 53 provided on the front and back surfaces of the dielectric substrate 11 need not to be located at completely the same height. For example, no trouble occurs in operation even if the connection portions 52 and 53 are deviated from each other in height. Furthermore, although the folded portions for phase matching (the connection portions 52 and 53) constitute one turn in the embodiments, the invention is not limited to this case and folded portions may be formed in plural turns.

Although in the first and second embodiments the slit-shaped cut 55 which is formed between the straight portion 54 and the parallel line portion 57 reaches the bottom edge of the dielectric substrate 11, it may be a slot-shaped hollow portion that does not reach the bottom edge of the dielectric substrate 11.

Although in the first and second embodiments the directors 56 and 58 are provided, one or both of them may be omitted.

Although in the first and second embodiments the coil 72 is deviated to the right side, the invention is not limited to this case. The coil 72 may be disposed on the left side or approximately at the center.

Although in the first embodiment the antenna device for the vehicle 1 is equipped with the SXM antenna 5, the AM/FM broadcast reception antenna 7, and the antenna board 10 in which the V2X communication colinear array antenna 50 is provided, one or both of the SXM antenna 5 and the AM/FM broadcast reception antenna 7 may be omitted if necessary. And the antenna device for the vehicle 1 may be equipped with an antenna having another function in place of the SXM antenna 5 or the AM/FM broadcast reception antenna 7.

Likewise, although in the second embodiment the antenna device for the vehicle 1A is equipped with the SXM antenna 5, the GNSS antenna 6, the AM/FM broadcast reception antenna 7, and the antenna board 10 in which the V2X communication colinear array antenna 50 is provided, one or all of the SXM antenna 5, GNSS antenna 6, and the AM/FM broadcast reception antenna 7 may be omitted if necessary. And the antenna device for the vehicle 1A may be equipped with an antenna having another function in place of the SXM antenna 5, the GNSS antenna 6, or the AM'FM broadcast reception antenna 7.

In the first and second embodiments, the straight portion 51, the connection portion 52, and the director 56 are formed on the left side surface of the dielectric substrate 11 and the straight portion 54, the connection portion 53, the director 58, and the parallel line portion 57 are provided on the right side surface of the dielectric substrate 11. However, the dielectric substrate 11 may be such that the straight portion 54, the connection portion 53, the director 58, and the parallel line portion 57 are provided on its left side surface and the straight portion 51, the connection portion 52, and the director 56 are provided on its right side surface.

Although in the first and second embodiments the colinear array antenna 50 is constructed by the conductor patterns provided on both surfaces of the dielectric substrate 11, a colinear array antenna similar to the colinear array antenna 50 may be constructed by a rod-shaped, thin-plate-shaped, or like conductors without using the dielectric substrate 11. Whereas this colinear array antenna provides the same advantages as in the first and second embodiments, the cost can be made lower than in the first and second embodiments because the colinear array antenna is formed without using the dielectric substrate 11.

Although in the first and second embodiments the straight portion 51 has the bent portion 51*a*, the straight portion 51 needs not to have the bent portion 51*a* if the length of the dielectric substrate 11 in the top-bottom direction is enough. Although the first and second embodiments are examples in which the slit-shaped cut 55 and the parallel line portion 57 are provided, one or both of the slit-shaped cut 55 and the parallel line portion 57 may be omitted if doing so does not cause any problem in the gain of the colinear array antenna 50. Furthermore, although in the first and second embodiments the straight portion 51 is inclined toward the front edge of the dielectric substrate 11, the straight portion 51 may be parallel with or inclined away from the front edge of the dielectric substrate 11 if doing so does not cause any problem in the gain of the colinear array antenna 50. Likewise, although the straight portion 54 is parallel with the front edge of the dielectric substrate 11, the straight portion 51 may be is inclined toward or away from the front edge of the dielectric substrate 11 if doing so does not cause any problem in the gain of the colinear array antenna 50. The straight portion 51 needs not to be inclined with respect to the extension direction of the straight portion 54 if it does not cause any problem in the gain of the colinear array antenna 50.

DESCRIPTION OF SYMBOLS

1, 1A: Antenna device for vehicle
2: Base
3: Case
5: SXM antenna
6: GNSS antenna
7: AM/FM broadcast reception antenna
10, 10A, 10B, 10C: Antenna board
11: Dielectric substrate
12: Through-hole
50: Colinear array antenna
51, 54: straight portion
52, 53: Connection portion
55: Slit-shaped cut
56, 58: Director
57: Parallel line portion
71, 71A: Capacitance loading element
72: Coil
90: Attachment board.

The invention claimed is:

1. An antenna device for a vehicle, comprising:
an antenna board; and
a colinear array antenna provided in the antenna board, wherein the colinear array antenna is constructed by a conductor pattern provided on each of both surfaces of a dielectric substrate, the colinear array antenna including:
a first straight portion;
a second straight portion;
a first connection portion one end of which is connected to the first straight portion and
a second connection portion one end of which is electrically connected to the first connection portion and another end of which is connected to the second straight portion,
wherein the first straight portion and the first connection portion are provided on a first surface of the dielectric substrate,
wherein the second straight portion and the second connection portion are provided on a second surface of the dielectric substrate opposite to the first surface,
wherein the first connection portion and the second connection portion are located on the dielectric substrate at approximately the same height, and
wherein the first straight portion and the second straight portion extend in directions opposite to each other with respect to a connecting portion at which the first connection portion and the second connection portion are electrically connected to each other.

2. The antenna device for the vehicle, according to claim 1, wherein
the first straight portion is inclined with respect to an extension direction of the second straight portion.

3. The antenna device for the vehicle, according to claim 2, wherein at least one of a first director that is parallel with the first straight portion and a second director that is parallel with the second straight portion is provided on the dielectric substrate.

4. The antenna device for the vehicle, according to claim 1, wherein
at least one of a first director that is parallel with the first straight portion and a second director that is parallel with the second straight portion is provided on the dielectric substrate.

5. The antenna device for the vehicle, according to claim 1, wherein
a parallel line portion that is parallel with the second straight portion is provided on the second surface of the dielectric substrate.

6. The antenna device for vehicle, according to claim 5, wherein
the dielectric substrate is formed with a cut or a hollow portion between the second straight portion and the parallel line portion.

7. The antenna device for the vehicle, according to claim 1, wherein
the colinear array antenna operates at a first frequency or a second frequency that is different from the first frequency.

8. The antenna device for the vehicle, according to claim 1, further comprising:
a capacitance loading element, wherein
the antenna board is spaced from the capacitance loading element in a direction in which the first connection portion and the second connection portion respectively extend from the first straight portion and the second straight portion.

9. The antenna device for the vehicle, according to claim 1, wherein the colinear array antenna operates as a vertically polarized wave antenna.

10. An antenna device for a vehicle, comprising:
an antenna board; and
a colinear array antenna provided in the antenna board, wherein
the colinear array antenna is constructed by a conductor pattern provided on each of both surfaces of a dielectric substrate, the colinear array antenna including:
a first straight portion;
a second straight portion;
a first connection portion one end of which is connected to the first strati lit portion; and
a second connection portion one end of which is electrically connected to the first connection portion and another end of which is connected to the second straight portion,
wherein the first straight portion and the first connection portion are provided on a first surface of the dielectric substrate,
wherein the second straight portion and the second connection portion are provided on a second surface of the dielectric substrate opposite to the first surface, and
wherein the first connection portion and the second connection portion constitute one turn for phase matching.

11. An antenna device for a vehicle, comprising:
an antenna board; and
a colinear array antenna provided in the antenna board, wherein
the colinear array antenna is constructed by a conductor pattern provided on each of both surfaces of a dielectric substrate, the colinear array antenna including:
a first straight portion;
a second straight portion;
a first connection portion one end of which is connected to the first straight portion; and
a second connection portion one end of which is electrically connected to the first connection portion and another end of which is connected to the second straight portion,
wherein the first straight portion and the first connection portion are provided on a first surface of the dielectric substrate, wherein the second straight portion and the second connection portion are provided on a second surface of the dielectric substrate opposite to the first surface, and wherein at least one of a first director that is parallel with the first straight portion and a second director that is parallel with the second straight portion is provided on the dielectric substrate.

* * * * *